US006969698B2

(12) United States Patent
Veltman

(10) Patent No.: US 6,969,698 B2
(45) Date of Patent: Nov. 29, 2005

(54) AEROSOL CLEANER

(75) Inventor: Jerome J. Veltman, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 58 days.

(21) Appl. No.: 10/823,531

(22) Filed: Apr. 13, 2004

(65) Prior Publication Data

US 2005/0227900 A1 Oct. 13, 2005

(51) Int. Cl.[7] ..... C11D 17/00

(52) U.S. Cl. ..... 510/180; 510/181; 510/238; 510/239; 510/403; 510/426; 510/488; 510/506

(58) Field of Search ..... 510/238, 239, 510/403, 426, 488, 506, 180, 181

(56) References Cited

U.S. PATENT DOCUMENTS

| | | | | |
|---|---|---|---|---|
| 3,819,522 | A | 6/1974 | Zmoda et al. | |
| 5,080,831 | A | 1/1992 | VanEenam | |
| 5,158,710 | A | 10/1992 | VanEenam | |
| 5,252,245 | A | 10/1993 | Garabedian, Jr. et al. | |
| 5,437,807 | A | 8/1995 | Garabedian, Jr. et al. | |
| 5,468,423 | A | 11/1995 | Garabedian, Jr. et al. | |
| 5,587,022 | A | 12/1996 | Black | |
| 5,641,742 | A | 6/1997 | Adamy et al. | |
| 5,650,543 | A | 7/1997 | Medina | |
| 5,786,319 | A | 7/1998 | Pedersen et al. | |
| 5,798,324 | A | 8/1998 | Svoboda | |
| 5,851,981 | A | 12/1998 | Choy et al. | |
| 5,922,668 | A | 7/1999 | Leonard et al. | |
| 5,948,741 | A | 9/1999 | Ochomongo et al. | |
| 5,952,287 | A | 9/1999 | Gross et al. | |
| 5,972,876 | A | 10/1999 | Robbins et al. | |
| 5,977,041 | A | 11/1999 | Honda | |
| 6,017,872 | A | 1/2000 | Pedersen et al. | |
| 6,090,765 | A | 7/2000 | Black et al. | |
| 6,130,196 | A | 10/2000 | Mondin et al. | |
| 6,194,362 | B1 | 2/2001 | Trinh et al. | |
| 6,221,823 | B1 * | 4/2001 | Crisanti et al. | 510/238 |
| 6,271,191 | B1 | 8/2001 | Kerobo et al. | |
| 6,281,178 | B1 | 8/2001 | Ryklin et al. | |
| 6,296,694 | B1 | 10/2001 | Miller | |
| 6,342,474 | B1 | 1/2002 | Kerobo et al. | |
| 6,399,553 | B1 | 6/2002 | Cable et al. | |
| 6,399,555 | B2 | 6/2002 | Robbins et al. | |
| 6,420,326 | B1 | 7/2002 | Maile et al. | |
| 6,425,406 | B1 | 7/2002 | Klinkhammer et al. | |
| 6,432,897 | B1 | 8/2002 | Cable | |
| 6,479,446 | B1 | 11/2002 | Sherry et al. | |
| 6,514,458 | B1 | 2/2003 | Czechowski et al. | |
| 6,551,001 | B2 | 4/2003 | Aberegg et al. | |
| 2002/0006759 | A1 | 1/2002 | Roberts et al. | |
| 2002/0069900 | A1 | 6/2002 | Evers | |
| 2002/0151448 | A1 | 10/2002 | Mitra et al. | |
| 2002/0151449 | A1 | 10/2002 | Fox et al. | |
| 2002/0155969 | A1 | 10/2002 | Rees et al. | |
| 2002/0187918 | A1 * | 12/2002 | Urban | 510/505 |
| 2003/0162678 | A1 * | 8/2003 | Ashton et al. | 510/285 |

* cited by examiner

*Primary Examiner*—Necholus Ogden

(57) ABSTRACT

Disclosed are aerosol emulsion cleaning sprays formulated for clarity and low residual tackiness. One form contains a mixture of diphenyloxide disulfonate hydrotrope and diphenyloxide disulfonate surfactant. Another form contains ethoxylated acetylenic glycol surfactants, preferably a mix of such surfactants.

12 Claims, No Drawings

AEROSOL CLEANER

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol emulsion spray cleaners that have been formulated to reduce residual tackiness and avoid visible residual film. Such formulations are particularly well suited to clean floors, walls and windows.

There have been a number of efforts to ease mopping and cleaning by mounting a container for a hard surface cleaning formulation on devices that have a mop head, cleaning brush, or the like (thus avoiding the need for a separate bucket containing the cleaning liquid). One such system is the Go Mop™ cleaning system marketed by S.C. Johnson & Son, Inc., embodiments of which are described in their U.S. Pat. No. 6,551,001 (the disclosure of this patent being incorporated by reference as if fully set forth herein).

Some systems of this type mount an aerosol can containing the hard surface cleaner near the mop head. An actuator/trigger near the opposite end of a mop handle is designed to initiate the aerosol spray, thereby spraying the floor adjacent the attached mop head. While such devices are primarily useful for floor cleaning, they can also be used/adapted to clean vertical walls (e.g. shower enclosure walls) or windows.

Of course, aerosol spray cleaners have also been deliver without a remote activation system. For example, a Windex® aerosol spray is marketed by S.C. Johnson & Son, Inc., primarily for cleaning windows. The aerosol can is held directly in the hand of the consumer, with the can spray being initiated in well known fashion (e.g. by pressing an activator button that opens a spray valve and delivers the spray to the desired window or other associated room surface).

Of course, a cleaning formulation that is optimized to clean glass windows will not necessarily be optimized to clean certain other surfaces. The art has tried to develop a number of so-called "all purpose" hard surface cleaners which can be used on a variety of such hard surfaces, with reasonable efficiency. However, some (particularly floor cleaners) leave an undesirable visible film on the floor after use, requiring a separate rinsing step. Still others leave a tacky (albeit invisible) residue, again requiring a rinsing step for certain applications. Still others use ingredients that work quite well for one surface, but not suitable for certain sensitive surfaces.

Prior art multi-purpose formulations also sometimes required extra amounts of cleaner to achieve certain desired cleaning results, due to compromises that had been made in formulating for multiple applications. This is particularly problematic (e.g. overly costly) in the case of aerosol formulations.

In U.S. Pat. No. 6,425,406 an aerosol emulsion toilet bowl spray cleaner was disclosed having water, glycol ether, nonionic surfactant, isobutane propellant, anionic surfactant, and acid (sulphamic acid). Further, in connection with a variety of aerosol can applications it is known that the use of sodium nitrite (or sodium benzoate) in small quantities can act as a corrosion inhibitor. Also, the use of vinegar as an adjunct in a variety of hard surface cleaners is also well known.

In other work, U.S. Pat. No. 5,587,022 described that low weight alcohols, such as isopropanol, and propylene glycol, along with polyalkoxylate block copolymers, had some desirable characteristics in hard surface cleaners designed for cleaning shower walls.

In still other work, U.S. Pat. No. 5,650,543 disclosed ethoxylated acetylenic glycol surfactants, such as an ethoxylated derivative of 2,4,7,9-tetramethyl-5-decyne-4,7-diol. However, it noted that they could suffer from certain wetting problems.

U.S. Pat. No. 6,017,872 described a variety of diphenyloxide disulfonate surfactants and hydrotropes having $C_1$–$C_{12}$ alkyl chains. However, that patent did not describe aerosol applications thereof.

In any event, there is a need to provide improved aerosol emulsion spray cleaners, particularly those having improved clarity and foaming characteristics on a wide variety of surfaces to be cleaned.

BRIEF SUMMARY OF THE INVENTION

In one aspect the invention provides an aerosol spray that contains at least 50% (more preferably at least 90%) water, at least 0.01% diphenyloxide disulfonate hydrotrope, at least 0.01% diphenyloxide disulfonate surfactant, and at least 1% (preferably 2–10%) propellant.

The diphenyloxide disulfonate hydrotrope is selected from compounds of the following formula:

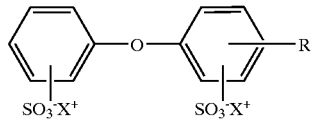

wherein, R has less than seven carbons and is alkyl or alkene, and X is an alkali metal. The preferred R groups are alpha olefins. The preferred alkali metal is sodium. Examples of such hydrotropes are certain Dowfax hydrotropes.

The diphenyloxide disulfonate surfactant can be selected from compounds of the following formula:

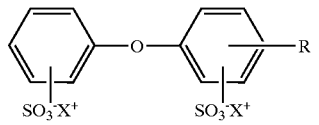

wherein, R has more than six carbons and is alkyl or alkene, and X is an alkali metal. The preferred R groups are alpha olefins, or tetrapolypropylene. The preferred alkali metal is sodium. Examples of such surfactants are certain Dowfax surfactants (such as Dowfax 2A1).

In preferred forms such a formula may also contain a polyoxypropylene/polyoxyethylene block polymer surfactant, and an alkyl sarcosinate surfactant. Such block polymers are sold under the name Pluronics or Pluronic R's, by BASF.

The above formulations may also contain an alcohol with less than six carbons (e.g. isopropanol and/or propylene glycol), a corrosion inhibitor (e.g. sodium nitrite or sodium benzoate), vinegar, a preservative (e.g. 4,4-dimethyloxazolidine-Bioban CS-1135), and/or a foam inhibitor.

Certain gaseous hydrocarbons (or mixtures thereof) can be used as the propellant. They typically liquefy under the pressure conditions of an aerosol can. For example, the propellant can be dimethylether, difluoroethane, propane, butane, isobutane and mixtures thereof (preferably isobutane alone). Alternatively, the propellant could be a non-hydrocarbon type of gas, such as $CO_2$.

In another form the invention provides an aerosol spray that contains at least 50% (more preferably at least 90%) water, at least 0.01% ethoxylated acetylenic glycol surfactant, and at least 1% (preferably 2–10%) propellant. The surfactant is preferably an ethoxylated $C_8$–$C_{20}$ acetylenic diol, most preferably an ethoxylated 2,4,7,9 tetramethyl, 5-decyne 4,7 diol, such as one selected from the following formula:

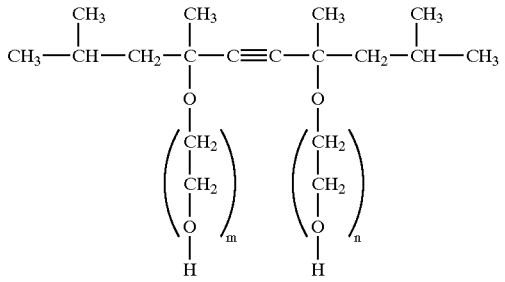

wherein n and m are each individually selected, and are each between 1 and 30 (preferably between 1 and 15).

The above formulations of the present invention are stable during long term storage, are environmentally friendly, do not leave a visible residue during normal use, do not leave a tacky residue during normal use, and provide acceptable cleaning for a wide variety of stain and dirt challenges. Further, these formulations can be easily blended and are inexpensive to produce.

These and still other advantages of the present invention will be apparent from the description which follows. In that description reference is made to certain preferred embodiments. However, the claims should be looked to in order to judge the full scope of the invention, and the claims are not to be limited to just the preferred embodiments.

DETAILED DESCRIPTION OF THE PREFERRED EMBODIMENTS

A. Overview

Preferred forms of the present invention are aerosol emulsion sprays containing nonionic acetylenic glycol based surfactant, or a mix of diphenyloxide disulfonate surfactant and diphenyloxide disulfonate hydrotrope. Both types typically have water, hydrocarbon propellant gas, glycol ether solvent(s), and optionally alcohols (e.g. isopropanol or propylene glycol), vinegar, sodium nitrite (or sodium benzoate), a preservative, and/or a foam inhibitor.

Other surfactants may also be present, and these formulations may also have other ingredients which are conventional in connection with hard surface cleaners (e.g. fragrances). While the formulations may have an acidic or basic pH, it is most preferred that the pH be between 8 and 10. Preferably the formulations have at least one surfactant with an HLB value over 12 (preferably over 15).

B. EXAMPLES

| chemical | Formula A | Formula B |
|---|---|---|
| Water | 91.784 | 91.488 |
| Isobutane | 4.0 | 4.0 |
| sodium nitrite | 0.096 | 0.096 |
| isopropanol | 2.88 | 2.88 |
| propylene glycol n-propyl ether | 0.96 | 0.96 |
| propylene glycol | — | 0.24 |
| Vinegar | 0.048 | 0.048 |
| 4,4-dimethyloxazolidine | 0.048 | 0.048 |
| Foam Ban MS 575 - glycol emulsion | 0.048 | — |
| Dowfax 2A1 sodium dodecyl diphenyloxide disulfonate | 0.019 | — |
| Dowfax hydrotrope sodium hexyl diphenyloxide disulfonate | 0.019 | — |
| sodium lauroyl sarcosinate | 0.062 | — |
| Pluronic 31 R1 polyoxypropylene polyoxyethylene block polymer | 0.036 | — |
| Surfynol 485 W acetylenic glycol surfactant (ethoxylated tetramethyl decyne diol) (HLB 17) | — | 0.144 |
| Surfynol 449 acetylenic glycol surfactant (ethoxylated tetramethyl decyne diol) (HLB 8) | — | 0.096 |

C. Test Data

To test our formulas, as well as certain prior art formulas we used the intermediate (the aerosol without the propellant gas in each case), and applied 0.5 grams of the formulation uniformly on a small area of black glass. We then wiped the glass with a paper towel until it appeared visually dry. We then inspected the glass.

For tests of our formulas A and B (without propellant gas) the glass appeared visually free of residue after this procedure, and when touching the glass we determined that the glass was free of perceivable tackiness. In contrast, a number of prior art aerosol floor sprays that we tested left a visually appreciable residual film, and/or left the surface somewhat tacky. Our formulations thus provided desirable low visual residue/low tackiness characteristics, without sacrificing desirable cleaning capability for a given quantity of cleaner used.

While the above describes preferred embodiments of the present invention, other embodiments are also within the scope of the invention. For example, neither alcohol nor vinegar need be present. Further, the particular gas propellant is not critical. Thus, the claims which follow should be looked to in order to judge the full scope of the invention.

INDUSTRIAL APPLICABILITY

The present invention provides improved aerosol sprays, particularly those that can be used on a wide variety of surfaces without a rinsing step.

What is claimed is:

1. An aerosol spray, comprising:

at least 50% water by weight;

at least 0.01% diphenyloxide disulfonate hydrotrope by weight, wherein the hydrotrope is selected from the group consisting of compounds of the following formula:

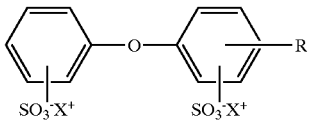

wherein R of the hydrotrope has less than seven carbons and is alkyl or alkene, and X of the hydrotrope is an alkali metal;

at least 0.01% diphenyloxide disulfonate surfactant by weight, wherein the surfactant is selected from the group consisting of compounds of the following formula:

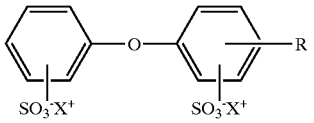

wherein R of the surfactant has less than eight carbons and is alkyl or alkene, and X of the surfactant is an alkali metal; and at least 1% propellant by weight, and further comprising a polyoxypropylene, polyoxyethylene block polymer surfactant and an alkyl sarcosinate surfactant.

2. The aerosol spray of claim 1, wherein the R of the hydrotrope is an alpha olefin and the X of the hydrotrope is sodium.

3. The aerosol spray of claim 1, wherein the R of the surfactant is selected from the group consisting of alpha olefins and tetrapolypropylene, and the X of the surfactant is sodium.

4. The aerosol spray of claim 1, further comprising an alcohol having less than six carbons.

5. The aerosol spray of claim 3, wherein the alcohol is selected from the group consisting of isopropanol and propylene glycol.

6. The aerosol spray of claim 1, further comprising a glycol ether.

7. The aerosol spray of claim 1, further comprising a corrosion inhibitor and acetic acid.

8. The aerosol spray of claim 1, wherein the propellant is a hydrocarbon propellant.

9. An aerosol spray, comprising:

at least 50% water by weight;

at least 0.01% ethoxylated acetylenic glycol surfactant by weight;

a polyoxypropylene, polyoxyethylene block polymer surfactant and an alkyl sarcosinate surfactant and at least 1% propellant by weight.

10. The aerosol spray of claim 9, wherein the surfactant is an ethoxylated $C_8$–$C_{20}$ acetylenic diol.

11. The aerosol spray of claim 10, wherein the surfactant is an ethoxylated 2,4,7,9 tetramethyl, 5-decyne 4,7 diol.

12. The aerosol spray of claim 11, wherein the surfactant is selected from the group consisting of compounds of the following formula:

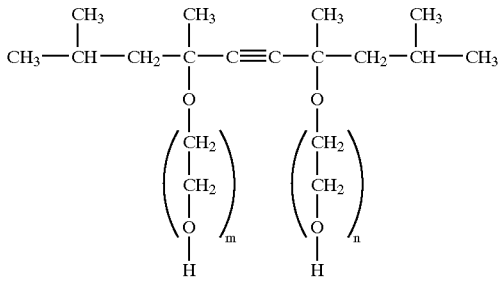

wherein n and m are each individually selected, and are each between 1 and 30.

* * * * *